US005860176A

United States Patent [19]

Norberg

[11] Patent Number: 5,860,176

[45] Date of Patent: Jan. 19, 1999

[54] PEDIATRIC CRITICAL CARE TRANSPORT SYSTEM

[76] Inventor: William J. Norberg, 6805 Rock Rd., San Antonio, Tex. 78229

[21] Appl. No.: 936,248

[22] Filed: Sep. 24, 1997

[51] Int. Cl.[6] ..... A61G 1/02

[52] U.S. Cl. ..... 5/628; 5/625; 128/870; 296/20

[58] Field of Search ..... 5/625, 626, 627, 5/628, 629, 611, 658, 503.1, 11; 296/20; 128/869; 1/870

[56] References Cited

U.S. PATENT DOCUMENTS

| | | | |
|---|---|---|---|
| 2,142,215 | 1/1939 | Schmidt | 5/625 X |
| 2,766,751 | 10/1956 | Topa | 128/134 |
| 2,972,755 | 2/1961 | Abel | 5/625 X |
| 3,046,982 | 7/1962 | Davis | 5/628 X |
| 3,737,923 | 6/1973 | Prolo | 5/628 |
| 3,838,687 | 10/1974 | Mosher | 128/200.11 |
| 3,890,659 | 6/1975 | Staubs | 5/627 X |
| 4,023,849 | 5/1977 | Bethlen | 296/20 |
| 4,060,079 | 11/1977 | Reinhold, Jr. | 128/145.8 |
| 4,124,908 | 11/1978 | Burns et al. | 5/82 R |
| 4,151,842 | 5/1979 | Miller | 5/628 X |
| 4,534,075 | 8/1985 | Schnitzler | 5/82 R |
| 4,912,787 | 4/1990 | Brodcovich | 296/20 X |
| 4,970,739 | 11/1990 | Bradford | 5/82 R |
| 5,044,031 | 9/1991 | Sherwood et al. | 5/625 X |
| 5,154,186 | 10/1992 | Laurin et al. | 128/870 |
| 5,337,992 | 8/1994 | Pryor et al. | 5/658 X |
| 5,400,448 | 3/1995 | Zwickey | 5/628 X |
| 5,481,770 | 1/1996 | Ahlsten | 5/625 |
| 5,494,051 | 2/1996 | Schneider, Sr. | 128/870 |
| 5,699,568 | 12/1997 | Couldridge | 5/628 |

FOREIGN PATENT DOCUMENTS

| | | | |
|---|---|---|---|
| 0165013 | 12/1985 | European Pat. Off. | 128/870 |
| 1514753 | 6/1978 | United Kingdom | 296/20 |

*Primary Examiner*—Kenneth J. Dorner
*Assistant Examiner*—Robert G. Santos
*Attorney, Agent, or Firm*—Jenkens & Gilchrist

[57] ABSTRACT

The present invention is a critical care transport system comprising a transport frame, a transport wrap, and a restraining belt system which is especially useful in inter-hospital transport of infants and children, or retrieval and transport of critically ill children from remote locations. The transport frame further comprises an upper frame divided into a lower tray and a hingedly adjustable upper tray which allows elevation of the patient's head even when the belt restraining system is fully engaged. The transport frame further comprises various apparatus for securing air and oxygen tanks, instrumentation, and medical care devices for use during transport. The transport wrap further comprises a series of contiguous flaps which, when engaged in a specified order, serve to restrain, comfort, and protect the patient. The belt restraining system comprises a series of buckles and belts which engage at a common locking point for distribution of transport forces over a wide area and comfortable, effective, secure transport of the patient.

24 Claims, 7 Drawing Sheets

PEDIATRIC CRITICAL CARE TRANSPORT SYSTEM

BACKGROUND OF THE INVENTION

1. Field of the Invention

This invention relates to critical care transport apparatus, and more particularly, to improved patient transportation apparatus used to transport critically ill children from the field to a nearby hospital, or between hospitals, by way of airplane, helicopter, or ground ambulances.

2. Background of the Invention

Emergency patient care of the type discussed herein, generally is that dispensed by rescue squad crews aboard light planes, helicopters, and ground ambulances. Further, the usual rescue situation will involve extraction of an infant or child from a remote location after receiving a critical injury.

It is customary for those skilled in this art to refer to a field device for supporting a patient in a horizontal transporting position as a stretcher. Devices in which patient transportation function is performed by two individuals carrying the device and patient are known as litters. While the pediatric critical care transport system of the present invention may be used as both a stretcher and a litter, all further references herein will be to a "stretcher".

Stretchers have a long been a standard adjunct to ambulatory care vehicles. So-called "ambulance stretchers" have become generally standardized in their dimensions. In recent years, ambulance stretchers have been equipped with permanently attached treatment equipment, such as heart-lung resuscitating devices, heart monitoring and ECG recording devices, defibrillating devices, and the like. These stretcher systems have served to expand the treatment capabilities to the patient at the location of injury, but at the same time, the systems of this type are invariably larger than standard ambulance stretcher dimensions. Such stretcher systems are not only increased in size in comparison with ambulance stretches, but in total weight as well. Consequently, movement of these systems when fully burdened may easily require up to four persons.

Further, movement of such enlarged systems to and from ambulatory care vehicles are restricted by their size. This is particularly apparent in situations where access to the patient requires movement of the system up and down stairways, along restricted openings, etc. When the transport environment includes a light aircraft or helicopter, the transport space involved is significantly reduced from that of a traditional ambulance. Thus, the patient must first be transported to the ambulatory vehicle before receiving the benefit of medical equipment monitoring, oxygen, etc. Further, upon reaching the destination where advanced critical care may be administered, the transportation crew is faced with making the choice of disconnecting the patient from all instrumentation for rapid evacuation from the ambulatory vehicle, or leaving electrical wires and fluid lines in places, but enlisting additional personnel to manage the equipment. These restrictions are usually enforced by the limited dimensions of the transport vehicle, which preclude accommodating a large stretcher apparatus with permanently attached equipment. Further, in the case of pediatric critical care transport from remote locations, two other difficulties are encountered. First, traditional stretchers are emphasized to accommodate the height and weight of an adult. The attachments for restraining a patient thereon are usually quite adjustable, but insufficient for practical restraint of a very small child. Second, traditional stretcher systems do not anticipate removal of critically injured children from areas where it is very cold. While the injured child may be wearing clothing sufficient for the environment, such clothing must often be removed for access to the injured portions of the body. Restraining wraps used for adults are often much too large for the child, and preclude adequate access to injured areas and areas available for monitoring vital signs. The end result is that critically injured children are often acutely uncomfortable during a time when they are also in great pain. This is because adult-sized transport apparatus necessitates exposure to the elements, including the down-wash of a helicopter which is used for transport.

Rigid stretcher systems also do not accommodate elevation of the patient's head for assistance in clearing the airway or preventing the patient from choking or suffocating on fluid in the mouth.

While some attempts have been made in the past to remove these difficulties, none have successfully integrated stretcher and restraining components into an integrated critical care transport system for infants and small children which accommodates needed critical care instrumentation in a size which enables transport by light planes and helicopters. U.S. Pat. No. 4,060,079, issued Reinhold, Jr. and U.S. Pat. No. 5,494,051, issued to Schneider, Sr. attempt to overcome the unwieldy operation of separate instrumentation and transport apparatus by providing a stretcher with integral instrumentation. However, neither apparatus is sized for use with children, and neither provides any significant elevation in the head. Further, there is no integrated restraint system which provides security, comfort, and protection from the elements.

U.S. Pat. No. 4,534,075, issued to Schnitzler and U.S. Pat. No. 5,481,770, issued to Ahlsten, both disclose a stretcher which allows elevation in the head, but does not provide any accommodation for instrumentation. Further, neither apparatus includes a restraint system appropriate to small children.

U.S. Pat. No. 4,124,908, issued to Burns et al. and U.S. Pat. No. 4,970,739, issued Bradford, teach a stretcher apparatus with integral restraint systems. However, neither of these devices is suitable for elevation of the head, and in fact, both are directed towards immobilization of the patient during spinal injury. Also, neither device provides for integrated or captured instrumentation.

U.S. Pat. No. 5,154,186, issued Laurin et al., discloses a spinal restraint device with the capability of accommodating instrumentation, but does not provide for elevation of the head, and is more specifically directed toward immobilization of the patient.

Therefore, the present invention is directed toward overcoming the transport difficulties encountered in the critical care transport of children as set forth above. It is desirable to have an apparatus which can safely secure the patient during a transport accident. It is also desirable to have an apparatus which allows access to the pediatric patient which allows movement as needed during medical intervention while properly restraining the patient. It is also desirable to have an apparatus which allows positioning the patient to protect the airway by allowing lateral and rotational movement, and even allowing the patient to sit up without modification of the safety restraint system. It is desirable that such a restraint system prevents the patient from being thrown around within, or out of the transport vehicle during an accident, and that such a restraint system be designed to avoid stress points and thereby significantly reduce the chance of causing additional injury during an accident.

Further, it is desirable to have a pediatric critical care transport system which provides protection from the extremes of the environment during the transport process. It is also desirable that the environmental protective restraint system allow access to the patient, while permitting comfortable and secure restraint, which decreases the psychological terror induced by using a "belt-only" system.

Further, it is desirable to provide a pediatric critical care transport system which provides an integrated platform for the attachment of specific devices to monitor the pediatric patient condition. Further, it is desirable to have a system which safely secures the attached monitoring equipment to the stretcher, while presenting the monitoring equipment in a usable position. It is also desirable to have a system which is strong and stable, lightweight, and provides a mechanism to safely and securely retain oxygen and compressed air tanks. It is also desirable to have a system which accommodates attachment of IV pumps and apparatus.

Further, it is desirable to have a pediatric critical care transport system that allows stable on-end storage and dramatically decreases the storage space needed for several similar devices. It is also desirable to have a system which incorporates an open compartment carrier to accommodate multiple brands of mechanical ventilators in a safe, secure, and functional position.

Further, it is desirable to have a pediatric critical care transport system that effectively restrains children and provides a wrap or body enclosure to completely encompass the body of a child to provide thermal protection from the environment, which is especially critical for the small infant, preventing heat loss from the exposed face and head. It is also desirable to have a system which incorporates insulation in the area along the head and ear to decrease the psychological stress of induced noise during aerial transport. It is also desirable to have a system which protects against the down-wash during the "hot loading" to a medical helicopter.

Further, it is desirable to have a pediatric critical care transport system which serves the multiple purposes of safety restraint and enclosure of exposed body sites, while simultaneously padding the patient in those areas subject to restraint. It is also desirable to have a system with the flexibility to accommodate access to IV lines, monitor leads, tubes, catheters, oximetry probes, etc. without loss to the environmental control or patient security or safety restraint. It is also desirable to have a system which is sized appropriately for small children and infants. It is also desirable to have a system in which the patient is protected from exterior heat by fire resistant materials.

Further, it is desirable to have a pediatric critical care transport system that provides restraint over both shoulders of the patient to accommodate sudden deceleration changes. It is also desirable to have a restraint system which effectively prevents the patient from being thrown around the interior of the transport vehicle, while allowing the patient to sit up. It is also desirable to have a system which prevents a single point for connection of shoulder straps and other restraining measures. It is also desirable to have a system which restrains safely, distributing the weight of the patient over a wide area on the body of the critically ill patient.

The pediatric critical care transport system as described herein fills an important need for a small number of high-risk pediatric patients who are undergoing inter-hospital transport, or rescue from a remote site. This type of patient requires protection from the elements, integrated monitoring and support equipment, and safe, comfortable restraint, provided by the present invention.

SUMMARY OF THE INVENTION

The present invention is a pediatric critical care transport system comprising a transport frame, a restraining wrap, and a restraining belt system. The transport frame further comprises an upper frame and a lower support structure, the upper frame being divided into an upper tray and a lower tray, and the lower support structure having wheels. The transport frame further comprises at least two instrumentation poles which also serve to maintain the system in an upright storage position. Further, the upper frame and lower support structure are angled to enable efficient use and movement within ambulatory vehicles, especially light aircraft and helicopters. The transport frame also has an open carrier compartment which accommodates mechanical ventilators; integrated restraining elements for oxygen and compressed air tanks, an integrated platform with attachment points for monitoring equipment; and a moveable upper tray to allow for elevation of the patient's head.

The restraining wrap further comprises thermal protection and padding which eliminates the need for additional blankets around the patient. Additional insulated padding is positioned over the head cover area of the patient to maintain a medically desirable neutral head position and reduce the psychological stress of induced noise during transport. The wrap also provides thermal isolation from extremes of hot or cold environments, and, due to the nature of its construction, provides easy access to the body of the patient for application of monitoring and treatment lines, tubes, etc., while preserving environment control, patient security, and safety. The snugly fitting wrap also increases the patient's sense of security in the transport environment, and thereby decreases the amount of psychological stress inherent in every emergency transport situation. The wrap head covering also folds in a unique manner to become a protective hood, while serving as a storage compartment for the entire wrap when stored.

The belt restraint system comprises two separate belts which restrain the shoulders from sudden deceleration while providing a single point of engagement for securing or releasing the patient. Further, the belt restraint system distributes the weight of restraint connections over a wide area and, working integrally with the wrap restraint system, avoids the likelihood of restraint-induced injury to the critically injured patient.

The transport frame, restraining wrap, and restraining belt system are also sized for use with infants and small children so as to effectively transport them in critical care situations. The above and other advantages of this invention will become apparent from the following more detailed description, in conjunction with the accompanying drawings and illustrated embodiments.

DESCRIPTION OF THE PREFERRED EMBODIMENT

Figure 1:
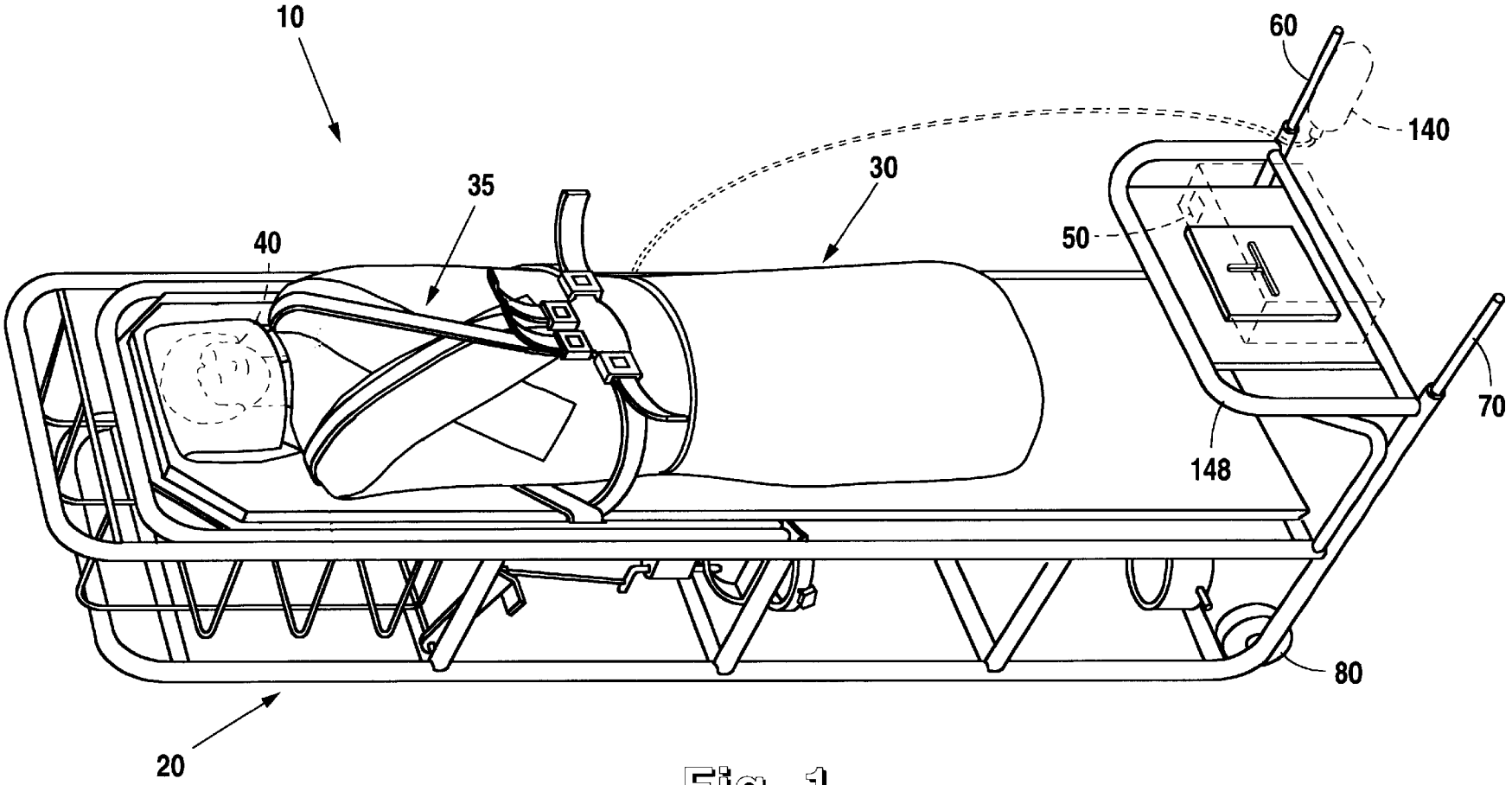
FIG. 1 is a perspective view of the critical care transport system of the present invention.

Turning now to FIG. 1, a perspective view of the pediatric critical care transport system 10 of the present invention can be seen. The transport system 10 comprises a transport frame 20, a transport wrap 30, and a belt restraining system 35. The patient 40 is held securely against a transport frame 20 by the synergistic combination of the transport wrap 30 and the belt restraining system 35, which serve to restrain the uncooperative patient 40, and at the same time protect the patient 40 from the elements and rapid acceleration and deceleration of emergency transportation. Instrumentation 50, which is not part of the present invention, can be accommodated securely and safely on shelf 148. The first instrument post 60 and the second instrument post 70 are adjustable in height, permanently affixed to the transport frame 20 and allow the use of IV apparatus 140 (not part of the present invention) and other apparatus which must be used during critical care of the patient 40 and is preferably left connected to the patient 40. The wheels 80, located at the lower corners of the transport frame 20 allow for movement of the critical care transport system 10, whether loaded or unloaded, by a single person. This is in direct contrast to prior art systems, which require a minimum of two persons to transport and operate.

Figure 2:
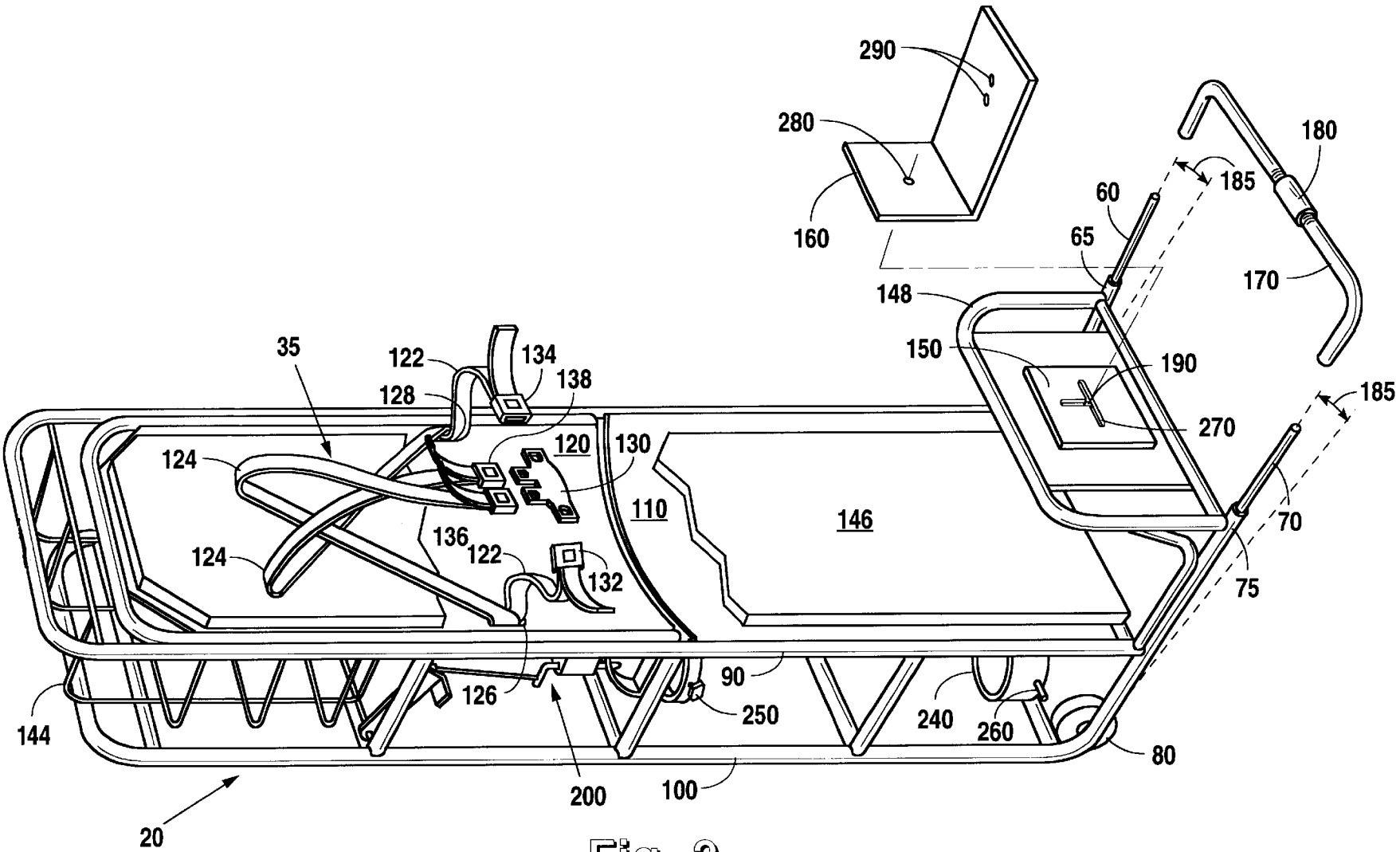
FIG. 2 is a downward-looking perspective view of the transport frame element of the present invention.

FIG. 2 illustrates the transport frame 20 of the present invention, which further comprises an upper frame 90 connected to a lower support structure 100. The upper frame 90 is further divided into an upper tray 120 and a lower tray 110. A hinge 115 (shown in FIGS. 3 and 4) serves to connect the upper tray 120 to the lower tray 110, while isolating the motion of the upper tray 120 from that of the lower tray 110; the upper tray 120 can be raised or lowered to accommodate specific patient care needs by way of the elevation mechanism 200. Upper and lower trays 110 and 120 are both concave to provide central positioning and security for the patient. Comfort padding 146, preferably constructed from ⅜ inch polyethylene closed-cell foam, overlays the majority of the surface area of the upper tray 120 and the lower tray 110. The use of comfort padding 146 produces a "double-mattress" system when combined with the transport rack wrap 30 of the present invention. In addition, such padding 146 allows the head of the patient to be elevated at various levels for specific critical care considerations.

The transport frame 20 further comprises a carrier 144, shown here in the form of an open basket or compartment which is completely enclosed by the frame 20. The carrier 144 must also provide easy access to the equipment residing therein. The carrier 144 may be constructed from a wire frame structure, as shown in FIG. 2, but may also be constructed from a cloth mesh bag, or any other device which allows access to the interior of the carrier 144 and is strong enough to contain respirators and other bulky medical care devices. Most preferably, the carrier 144 comprises an integrated welded compartment which is accessible for equipment storage and secure enough to accommodate multiple brands of mechanical ventilators in a safe, secure and functional position.

As depicted in FIG. 2, the transport frame 20 preferably has shelf 148 permanently affixed thereto. The shelf 148 is an integrated platform with an instrument specific mounting plate 150 mounted thereon. The instrument mounting slot 270 and mounting screw 190 (also shown in FIG. 3) allow the user of the critical care transport system 10 to securely attach specific brands of monitoring equipment in a transport-usable position. For instrumentation which does not lend itself to direct mounting via instrument mounting plate 150, an instrument mounting adapter 160 can be fashioned and attached to the instrument mounting plate 150 via shelf mounting hole 280, which is threaded to accept the mounting screw 190. The instrument mounting holes 290 are used for direct attachment to the particular instrumentation desired for critical care of the patient by the user. If the monitoring instrumentation used by the care giver is not amenable to mounting via the instrument mounting plate 150, or the instrument mounting adapter 160, then it can be suspended from a post bridge 170, which is designed to slip over the ends of the first and second instrument posts 60 and 70. A bridge retractor 180 is used to adjust the length of the post bridge 170 for firm attachment to the first and second instrument posts 60 and 70.

When the post bridge 170 is not required, the first and second instrument posts 60 and 70 can be used to accommodate IV pumps or bottles. The first and second instrument posts 60 and 70 move adjustably within the first and second frame posts 65 and 75, respectively. Locking screws (not shown) or other means, such as pins or threaded connections, are used to secure the height of the first and second instrument posts 60 and 70 within the first and second frame posts 65 and 75, which are rigidly attached to the transport frame 20.

The first and second frame posts 65 and 75 are angled inwardly toward each other in order to provide reduced projection of instrumentation and other items suspended thereon into the environment surrounding the critical care transport system 10. Further, the first and second frame posts 65 and 75 are both angled upwardly toward carrier 144 so as to provide a stable on-end storage platform for the transport frame 20. The instrument post angle 185 is preferably fixed at approximately 5 degrees away from being perpendicular (i.e., about 85 degrees between the plane encompassing the frame posts and the plane encompassing the transport frame) to accommodate such on-end storage.

FIG. 2 also depicts another element of the critical care transport system 10, that is, a belt restraining system 35, which is further comprised of a waist belt 122 and a shoulder belt 124. Each of the waist and shoulder belts 122 and 124 comprise a single length of webbing or other strong material which passes through a multiplicity of holes in the upper tray 120, and terminate on each end with a pair of buckles. The waist belt 122 is terminated at a first end by a first waist buckle 132 at the front of the upper tray 120, passes through a first belt hole 126, continues around the back of the upper tray 120 to emerge through a second belt hole 128 and is terminated at a second end by a second waist buckle 134. Similarly, the shoulder belt 124 is terminated at a first end by a first shoulder buckle 136 at the front of the upper tray 120, continues around the patient's right shoulder, behind the patient's back, through the first belt hole 126 and around the back of the upper tray 120 to emerge at the second belt hole 128. The shoulder belt 124 then continues onward around the back of the patient and over the patient's left shoulder to be terminated at a second end by a second shoulder buckle 138. While a multiplicity of belt holes may be used to secure waist and shoulder belts 122 and 124 to upper tray 120, the use of only two such holes is preferred.

The first and second waist buckles 132 and 134, and first and the second shoulder buckles 136 and 138 are preferably identical to those used in commercial aircraft, but can be of a type similar to those used in automobiles. Each of the buckles 132, 134, 136, and 138 engage securely with a buckle lock 130, which is located over the abdomen of the patient. This centralized locking system, along with the use of aircraft-quality buckles and webbing result in a belt restraining system 35 which meets FAA safety regulations for air transportation.

Figure 3:
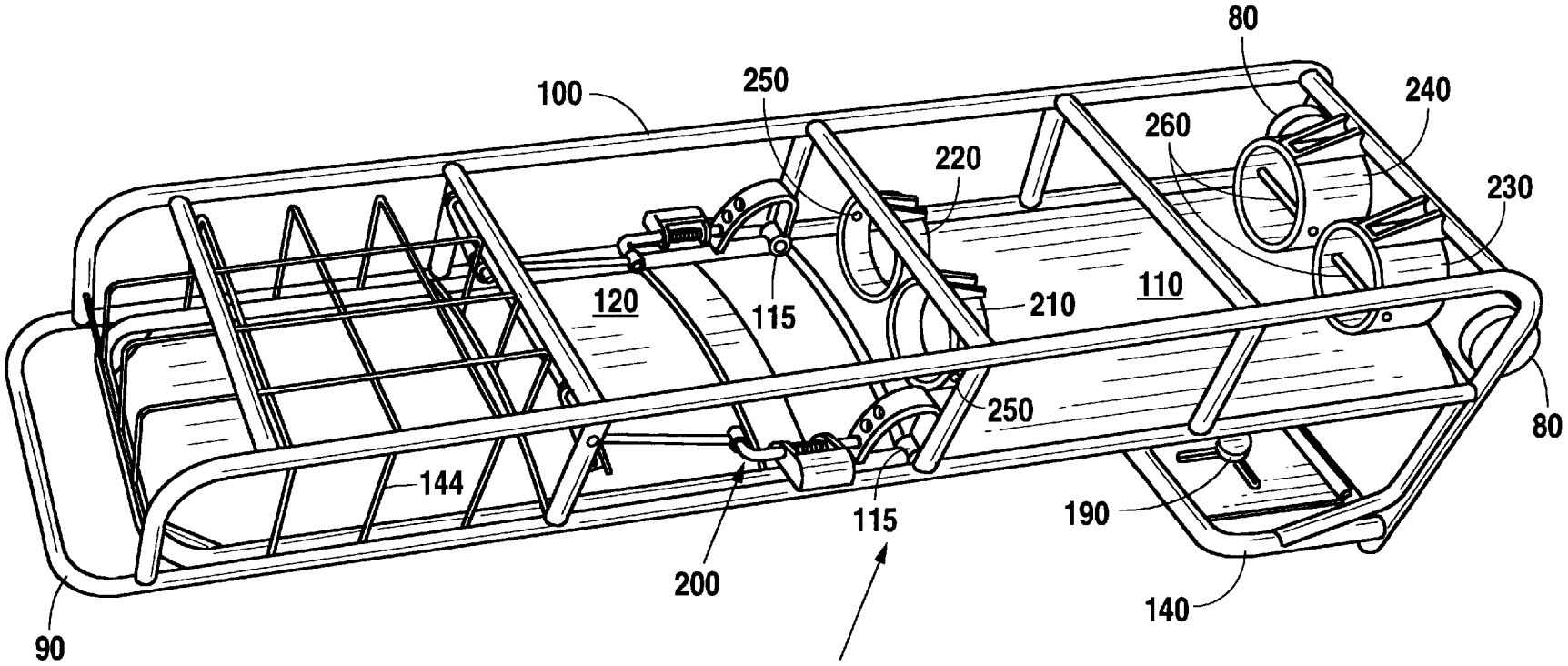
FIG. 3 is an upward-looking perspective view of the transport frame element of the present invention.

Turning now to FIGS. 2 and 3, additional features of the present invention can be seen. Most notably, this includes the means to secure oxygen and compressed air tanks within the transport frame 20. Lower support structure 100 is preferably welded to upper frame 90 at a distance which allows carrier 144 and any oxygen or compressed air tanks mounted within transport frame 20 to be completely enclosed. The open structure of transport frame 20 provides a strong and stable platform which simultaneously allows easy access to all enclosed components. More particularly, oxygen or compressed air tanks can be securely accommodated by the first and second tank head restraints 210 and 220, and the first and second tank foot restraints 230 and 240. To place a tank within the structure of the transport frame 20, the user simply loosens the tank head fixing screws 250 and removes the tank foot locking bars 260. The tank is then inserted between the wheels 80 of the transport frame 20 through either of the first or second tank foot restraints 230 and 240 and upwardly onward into the first corresponding or second tank head restraints 210 and 220 until the neck of the tank is proximate to the tank head fixing screws 250. At this point, the tank head fixing screws 250 are used to secure the neck of the tank while the user ensures that regulators or other flow control devices are properly oriented for manual access. Further, the first and second tank head restraints 210 and 220 are located at differing longitudinal distances from the respective first and second tank foot restraints 230 and 240 so that the tank regulator mechanisms and other instrumentation do not interfere with each other. Once the tank head fixing screws 250 have been secured, the tank foot locking bars 260 can be moved into placed and locked. The combination of the first and second tank head restraints 210 and 220, the first and second tank foot restraints 230 and 240, the tank head fixing screws 250 and the tank foot locking bars 260 provide a framework which prevents forward and rearward displacement of compressed air or oxygen tanks in the event of a transportation accident, as well as during routine movement of the critical care transport system 10. The tank head restraints 210 and 220, and the tank foot restraints 230 and 240, can also be replaced by commercially available constriction brackets (not shown), each comprising a circular collar and closure screw, which can be attached to the transport frame 20 so as to encircle the compressed air or oxygen tanks proximate to the shoulder and foot of each tank, thereby locking them in place.

Figure 4A:
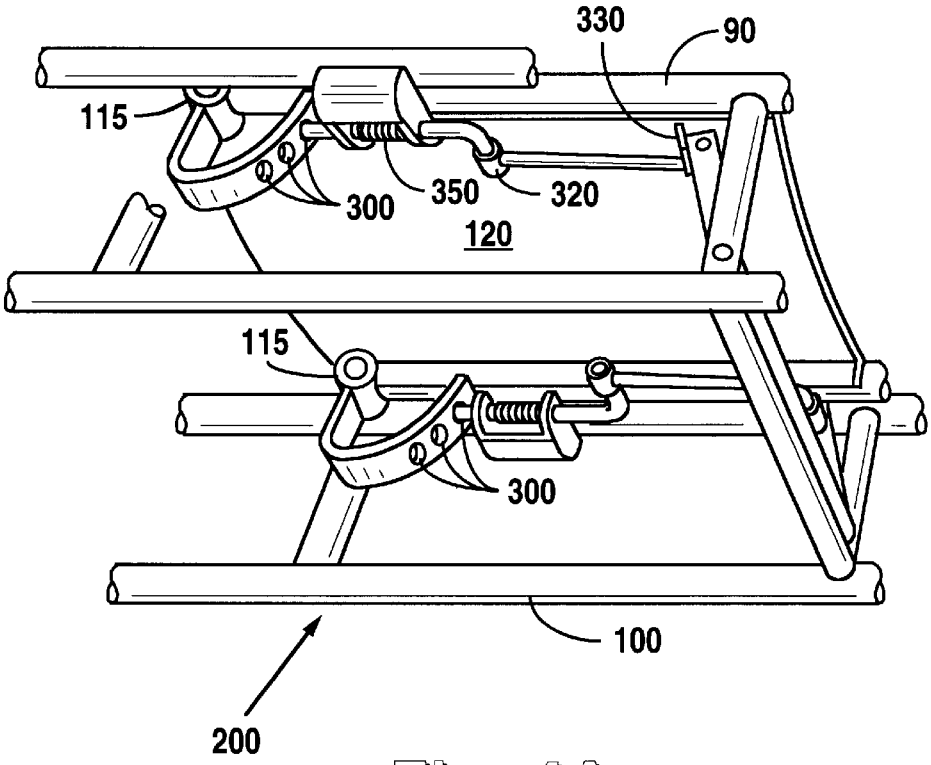
FIGS. 4A and 4B are perspective and side views of the head elevation mechanism of the present invention, respectively.
Figure 4B:
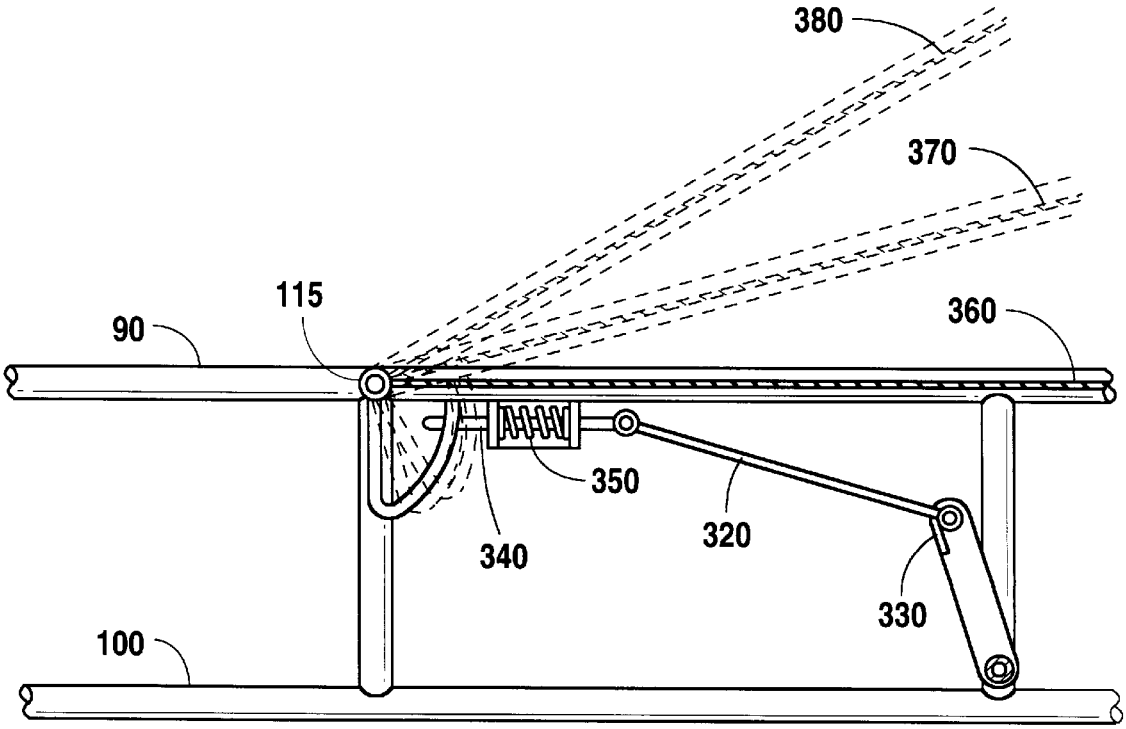

FIGS. 4A and 4B illustrate perspective and side views of the elevation mechanism 200, respectively. As mentioned previously, the hinges 115 permit independent motion of the lower tray 110 and the upper tray 120. The lower tray 110 is preferably fixed to the upper frame 90, and does not move. However, the upper tray 120 pivots about the hinges 115 so that the upper tray 120 can be secured in either of three locations: at a base elevation 360, a first elevation 370, or a second elevation 380. Each elevation is selected by manual operation of the release lever 330, which in turn moves the release bar 320 and ultimately, the release pin 340 into and out of a multiplicity of elevation holes 300. The release spring 350 serves to urge the release pin 340 into whichever of the elevation holes 300 is most proximate. While the first elevation 370 and the second elevation 380 are preferably located at approximately 15° and 30° away the from base elevation 360, respectively, the first and second elevations 370 and 380 can also be located at any other desired angle between 0° and 90°. Also, other numbers of elevations are possible; the angle and number of which are selected by the location and number of the elevation holes 300. The elevation mechanism 200 of the present invention, providing secure and adjustable elevation of the patient's head, performs the functions of providing access to equipment in the carrier 144, positioning the patient at various elevations, and securely supporting the patient during normal and emergency (i.e., accident) situations.

Figure 5:
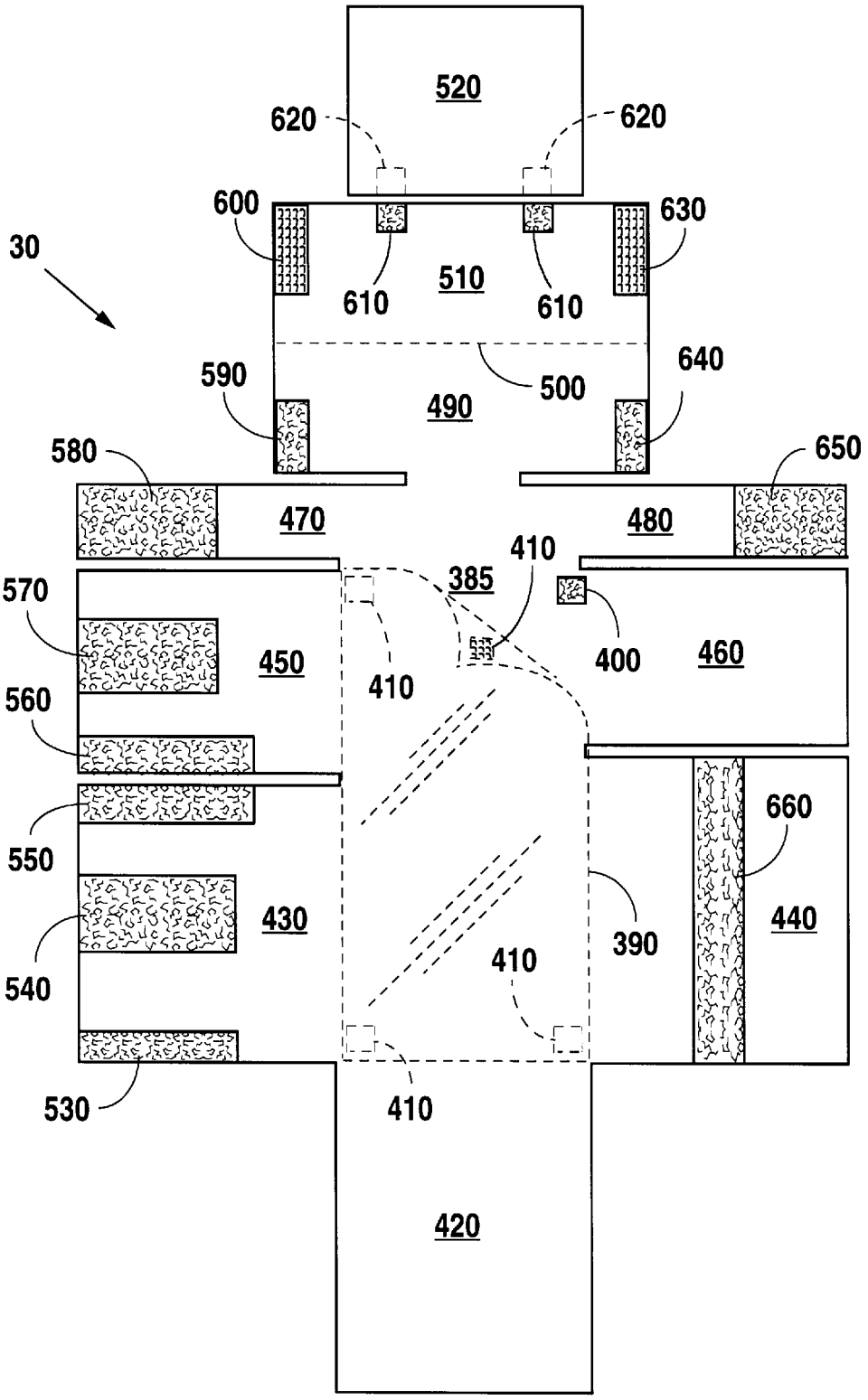
FIG. 5 is a top view of the restraining wrap of the present invention.

Turning now to FIG. 5, the transport wrap 30, another element of the critical care transport system 10 of the present invention, can be seen. The wrap 30 comprises a uniquely patterned construction which can be assembled to completely surround the patient while providing several access points for IV lines, monitor leads, tubes, catheters, oximetry probes, and other medical instrumentation without loss of environmental control, patient comfort or safety restraint capability.

The wrap 30 is preferably constructed from nylon or Nomex® (e.g., when fire protection is desired) and filled with goose down or a synthetic insulation material, such as polyester, as is well known in the art. The wrap body 385 is surrounded by several contiguous components, including a foot flap 420, first and second lower flaps 430 and 440, first and second upper flaps 450 and 460, first and second shoulder flaps 470 and 480, and a head flap 490. The wrap body 385 can be optionally overlaid with a moisture barrier 390, which may be fabricated from any non-permeable and flexible material, such as polypropylene. The barrier 390 is affixed to the wrap body 385 by means of barrier loops 410 and barrier hooks 400, which are permanently attached to the wrap body 385 and the barrier 390, respectively.

The face wrap 510 is contiguously attached to the head flap 490 along a head fold line 500, which may be formed by sewing a seam through the wrap material and filling. The wind flap 520 presently consists of a rectangular piece of material which may be attached to the face flap 510 by means of hook and loop fastener material, designated as wind flap hook fasteners 610 and wind flap loop fasteners 620, as desired by the attending caretaker. Various pieces of hook and loop fastener material are also used to secure the patient within the transport wrap 30, including first, second and third lower hook fasteners 530, 540, and 550; first and second upper hook fasteners 560 and 570; first and second shoulder hook fasteners 580 and 650; first and second head hook fasteners 590 and 640; first and second face loop fasteners 600 and 630; and a foot hook fastener 660.

Figure 6:
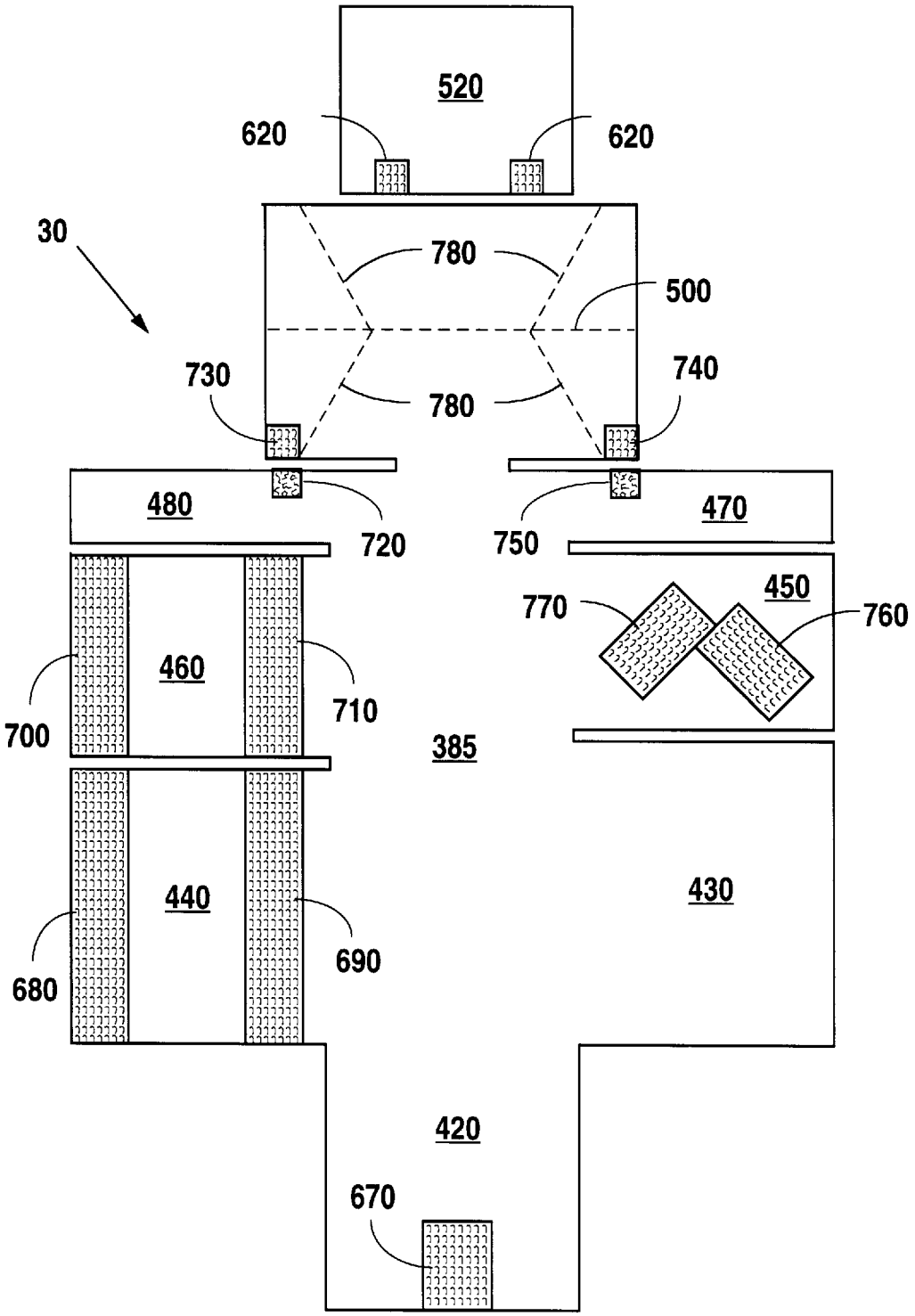
FIG. 6 is a bottom view of the restraining wrap of the present invention.

FIG. 6 illustrates the structure of the bottom side of the transport wrap 30 element of the present invention. Additional hook and loop fastener securing elements include: a foot loop fastener 670; first and second lower loop fasteners 680 and 690; first and second upper loop fastener 700 and 710; first and second hood hook fasteners 750 and 720; first and second hood loop fasteners 730 and 740; and first and second shoulder loop fasteners 760 and 770. Hood fold lines 780, which can be constructed in the manner previously mentioned for the head fold line 500, are also illustrated.

Figure 7D:
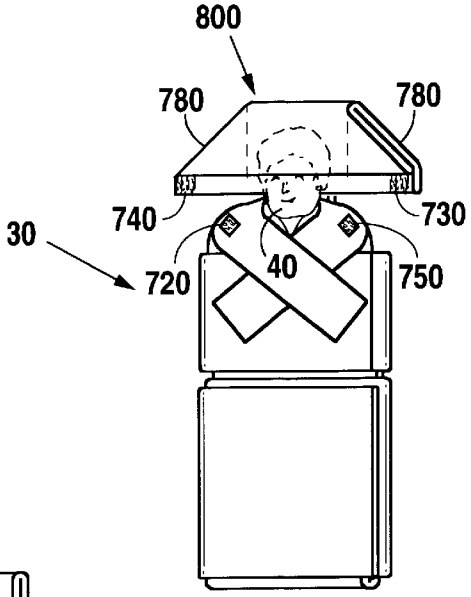
FIGS. 7A–7D are top views of several steps in the sequence of applying the wrap restraint element to the patient.
Figure 7C:
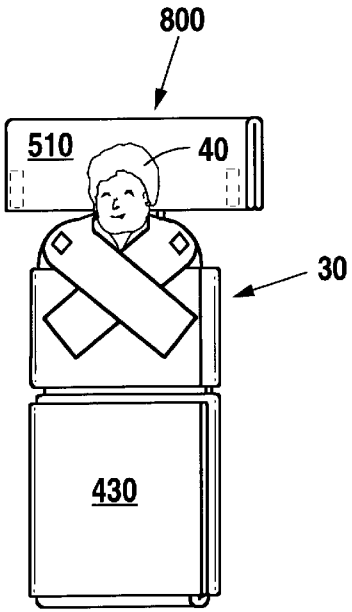
Figure 7B:
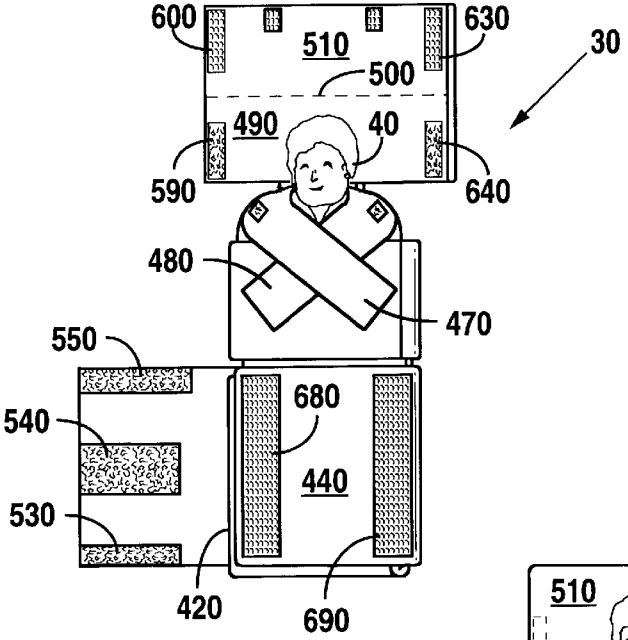
Figure 7A:
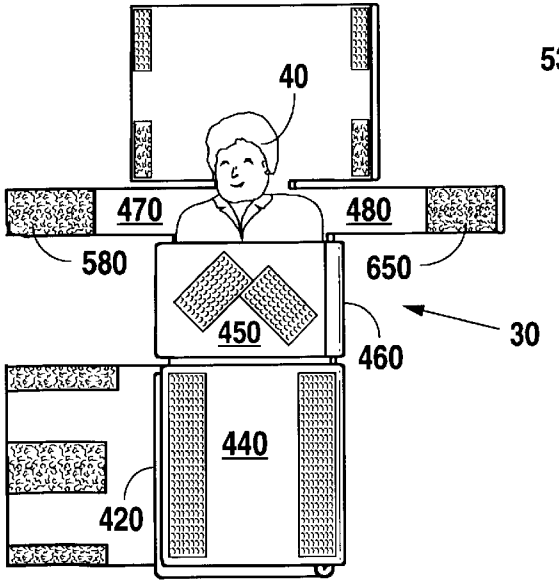

FIGS. 7A–7D illustrate the process of securing a patient 40 within the transport wrap 30 element of the present invention. Turning now to FIG. 7A, it can be seen that the foot flap 420 has been folded upwardly over the legs of patient 40 and secured by the interaction between the foot loop fastener 670 and the foot hook fastener 660, which is preferably constructed as a continuous length of hook fastening material spanning the vertical length of the second lower flap 440. The exact location of the foot loop fastener 670 along the length of the foot hook fastener 660 is determined by the height of the patient 40. In addition, FIG. 7A illustrates the closure of the second upper flap 460, as secured by the first upper flap 450, and the interaction between the first and second upper loop fasteners 700 and 710, and the first and second upper hook fasteners 560 and 570.

FIG. 7B depicts the sequential closure of the second shoulder flap 480 and then, the first shoulder flap 470. The second shoulder flap 480 is secured by the interaction between the second shoulder hook fastener 650 and the second should loop fastener 770. The first shoulder flap 470 is secured by the interaction between the first shoulder hook fastener 580 and the first shoulder loop fastener 760. The first and second should flaps 470 and 480 serve multiple purposes, including restraint for psychological security, restraint for safety, closure of open sites to cold air entry, and providing intervening padding for emergency transport activity against the pulling action of shoulder belt 124.

FIG. 7C depicts the sequential closure of the first lower flap 430 over the second lower flap 440, caused by interaction between the first and second lower loop fasteners 680 and 690, and the first, second and third lower hook fasteners 530, 540 and 550. Additionally, the formation of a hood 800 is shown. The hood 800 is formed by folding the face flap 510 downward along the head fold line 500 toward the patient 40 so that the first face loop fastener 600 attaches to the first head hook fastener 590, and the second face loop fastener 630 attaches to the second head hook fastener 640. The hood 800 may be used to enclose the head of the patient 40, or it may be left as is to provide additional padding behind the head of patient 40. The use of the hood 800 may also be determined by the environment (i.e., hot or cold) surrounding the patient 40. An alternative embodiment of the wrap 30 anticipates permanently forming the hood 800 by folding the face flap 510 downward along the head fold line 500, and then sewing each side of the hood 800 closed, obviating the need for first and second head hook fasteners 590 and 640, and first and second face loop fasteners 600 and 630. This permanent hood 800 configuration is illustrated in FIG. 7C.

FIG. 7D depicts an optional formation of the hood 800 into a more confining structure by making use of the hood fold lines 780 to form inwardly directed triangles which provide additional insulation to the head of the patient 40 and decrease the psychological stress of induced transport noise. For additional security and comfort, the first hood loop fastener 730 may be attached to the first hood hook fastener 750. Additionally, the second hood hook fastener 720 may be attached to the second hood loop fastener 740. This has the effect of opening up the hood 800 structure around the head of the patient 40 and also helps maintain a medically desirable neutral head position. An alternative embodiment of the wrap 30 also anticipates the use of buttons, loops, and snaps to take the place of the hook and loop fastener material shown in the drawings. By way of example and not of limitation, first and second hood loop fasteners 730 and 740 can be replaced by buttons or male snap components, while first and second hood hook fasteners 750 and 740 can be replaced by fabric or corded loops (to receive the buttons) or female snap components.

As mentioned previously, the wind flap 520 can be attached to the inside of the hood 800 by means of the wind flap fasteners 610 and the wind flap loop fasteners 620 to completely cover the face of the patient 40 when helicopter down-draft hot loading is expected or the weather is rainy, for example.

The unique configuration provided by the transport wrap 30 provides thermal protection from hot or cold environments surrounding the patient 40, and the insulation materials incorporated into the wrap 30 eliminate the need for additional blankets around the patient 40. Additionally, it should be noted that even when the patient 40 is entirely enclosed by the wrap 30, as depicted in FIG. 7D, access to the patient 40 is facilitated by the environmental openings created at the junctures of the foot flap 420 and the first and second lower flaps 430 and 440; the first and second upper flaps 450 and 460, and the first and second lower flaps 430 and 440; the first and second shoulder flaps 470 and 480, and first and second upper flaps 450 and 460. Additionally, the restraining wrap 30 can be folded into a small bundle which fits neatly into the hood 800 for containment within carrier 144. This feature of the present invention is unknown in any of the prior art.

While the restraining wrap 30 is useful for transport of any sized person, it is most effective when sized appropriately for the particular patient. Most preferably, use of the critical care transport system 10 includes the choice of a transport frame 20 which is approximately 60 inches long to accommodate children from infancy to approximately ten years old. Further, the restraining wrap 30 is preferably made available in three different sizes to accommodate this same age range and the appropriate wrap can be selected by the caretaker. While the wrap 30 has been described as being constructed from nylon, Nomex®, down, or synthetic insulating material, other materials as commonly used in sleeping bags, such as Thinsulate®, can be used. It is the synergistic combination of the transport frame 20, the transport wrap 30, and the belt restraining system 35 which produces a uniquely constructed critical care transport system 10 that is not disclosed by the prior art.

Although the invention has been described with reference to a specific embodiment, this description is not meant to be construed in a limiting sense. Various modifications of the enclosed embodiment will become apparent to those skilled in the art upon reference to the description of the invention. It is, therefore, contemplated that the following claims will cover such modifications, alternatives, and equivalents that fall within the true spirit of the scope of the invention.

I claim:

1. A pediatric critical care transport system comprising:

a transport frame further comprising an upper frame connected to a lower support structure, said upper frame divided into an upper tray having a multiplicity of belt holes and a lower tray, said upper tray hingedly connected to said lower tray and movable by an elevation mechanism, said upper and lower trays being concave, and said lower support structure having wheels;

a transport wrap, said wrap further comprising a wrap body contiguously connected to a foot flap, first and second lower flaps, first and second upper flaps, first and second shoulder flaps, and a head flap, said head flap being connected to a face flap; and a belt restraining system, comprising a waist belt connected to two waist buckles, a shoulder belt connected to two shoulder buckles, and a buckle lock, said waist and shoulder buckles engaging said buckle lock and said upper tray by way of said multiplicity of belt holes.

2. The transport system of claim 1 wherein said transport frame further comprises a first and second instrument post and a first and second frame post, said first instrument post moving adjustably within said first frame post, and said second instrument post moving adjustably within said second frame post.

3. The transport system of claim 2 wherein said first and second frame posts are fixedly attached to said transport frame at an instrument post angle, said angle being about five degrees.

4. The transport system of claim 3 wherein said first and second frame posts are angled inwardly towards each other.

5. The transport system of claim 1 wherein said transport frame further comprises a carrier and a shelf, said carrier completely enclosed within said transport frame, and said shelf having an instrument mounting plate.

6. The transport system of claim 1 wherein said transport frame further comprises a first and second tank head restraint, and a first and second tank foot restraint, said restraints being completely enclosed within said transport frame.

7. The transport system of claim 1 wherein said upper and lower trays are overlaid by comfort padding.

8. The transport system of claim 1 wherein said elevation mechanism further comprises a multiplicity of elevation holes and a release pin, said pin engaging a selected one of said multiplicity of elevation holes.

9. The transport system of claim 1 wherein said wrap further comprises a moisture barrier.

10. The transport system of claim 1 wherein said wrap further comprises a wind flap.

11. The transport system of claim 1 wherein said wrap further comprises hook and loop fasteners.

12. The transport system of claim 1 wherein said wrap further comprises buttons and loop fasteners.

13. The transport system of claim 1 wherein said head flap and said face flap are formed into a hood.

14. The transport system of claim 11 wherein said head flap and said face flap are formed into a hood.

15. A pediatric critical care transport system comprising:

a transport frame further comprising an upper frame connected to a lower support structure, a first and second instrument post, a first and second frame post attached to said transport frame, a carrier, a shelf, a first and second tank head restraint, and a first and second tank foot restraint, said upper frame divided into an upper tray having a multiplicity of belt holes and a lower tray, said upper tray hingedly connected to said lower tray and movable by an elevation mechanism, said upper and lower trays being concave, said lower support structure having wheels, said first instrument post moving adjustably within said first frame post, said second instrument post moving adjustably within said second frame post, said carrier and said restraint, being completely enclosed within said transport frame between said upper frame and said lower support structure, and said shelf attached to said frame post and having an instrument mounting plate;

a transport wrap, said wrap further comprising a wrap body contiguously connected to a foot flap, first and second lower flaps, first and second upper flaps, first and second shoulder flaps, and a head flap, said head flap connected to a face flap; and a belt restraining system, comprising a waist belt connected to two waist buckles, a shoulder belt connected to two shoulder buckles, and a buckle lock, said waist and shoulder buckles engaging said buckle lock and said upper tray by way of said multiplicity of belt holes.

16. The transport system of claim 15 wherein said first and second frame posts are fixedly attached to said transport frame at an instrument post angle, said angle being about five degrees.

17. The transport system of claim 15 wherein said first and second frame posts are angled inwardly towards each other.

18. The transport system of claim 15 wherein said upper and lower trays are overlaid by comfort padding.

19. The transport system of claim 15 wherein said elevation mechanism further comprises a multiplicity of elevation holes and a release pin, said pin engaging a selected one of said multiplicity of elevation holes.

20. The transport system of claim 15 wherein said wrap further comprises a moisture barrier.

21. The transport system of claim 15 wherein said wrap further comprises a wind flap.

22. The transport system of claim 15 wherein said wrap further comprises hook and loop fasteners.

23. The transport system of claim 22 wherein said head flap and said face flap are formed into a hood.

24. The transport system of claim 15 wherein said wrap further comprises button and loop fasteners.

* * * * *